US005341928A

United States Patent [19]

Jones et al.

[11] Patent Number: 5,341,928

[45] Date of Patent: Aug. 30, 1994

[54] ADD-ON POCKET FOR GOLF BAGS

[75] Inventors: Allan L. Jones, Redmond; Lane James, Brier, both of Wash.

[73] Assignee: J&J Sports Products, Redmond, Wash.

[21] Appl. No.: 62,077

[22] Filed: May 14, 1993

[51] Int. Cl.[5] ..... A63B 71/00; A63B 57/00; A45C 7/00

[52] U.S. Cl. ..... 206/315.5; 190/102; 190/103; 190/108; 383/3; 383/37; 383/120; 224/918; 224/919

[58] Field of Search ..... 206/315.2, 315.3, 315.5; 383/3, 120, 37; 190/102, 103, 108; 224/274, 918, 919; 150/111

[56] References Cited

U.S. PATENT DOCUMENTS

| | | | |
|---|---|---|---|
| 715,759 | 12/1902 | Crane | 206/315.9 |
| 791,172 | 5/1905 | Winslow | 206/315.5 X |
| 1,532,941 | 4/1925 | Pierce | 206/315.5 |
| 1,703,540 | 2/1929 | Pierce | 206/315.5 |
| 1,718,952 | 7/1929 | Fischer | 206/315.9 |
| 1,739,780 | 12/1929 | Buhrke | 224/918 X |
| 1,774,589 | 9/1930 | Broeske | 383/120 X |
| 2,283,412 | 5/1942 | Bright | 206/315.5 |
| 2,450,040 | 9/1948 | Gibson | 383/2 |
| 2,587,029 | 2/1952 | Burton, Jr. et al. | 206/315.5 |
| 2,672,903 | 3/1954 | Machinist | 150/111 |
| 3,334,910 | 8/1967 | Wilson et al. | 206/315.5 X |
| 3,373,911 | 3/1968 | Kebelbeck | 206/315.3 X |
| 4,032,054 | 6/1977 | Duncan | 224/274 |
| 4,142,563 | 3/1979 | Ackerfeldt et al. | 206/315.5 |
| 4,350,194 | 9/1982 | Brown | 206/315.5 |
| 4,459,827 | 7/1984 | Rhodes | 224/919 X |
| 4,466,124 | 8/1984 | Kirkham, Jr. | 383/2 |
| 4,869,365 | 9/1989 | Perdue et al. | 224/918 X |
| 4,974,709 | 12/1990 | Furlow et al. | 190/102 |
| 5,096,059 | 3/1992 | Henderson | 206/315.3 X |
| 5,228,547 | 7/1993 | Yoo | 190/103 |

FOREIGN PATENT DOCUMENTS

| | | | |
|---|---|---|---|
| 8402 | 4/1933 | Australia | 206/315.4 |
| 613456 | 1/1961 | Canada . | |
| 2631845 | 1/1978 | Fed. Rep. of Germany | 383/40 |
| 1479879 | 5/1967 | France | 150/117 |
| 2358124 | 2/1978 | France | 190/102 |
| 2559040 | 8/1985 | France | 190/103 |

*Primary Examiner*—Sue A. Weaver

*Attorney, Agent, or Firm*—Christensen, O'Connor, Johnson & Kindness

[57] ABSTRACT

A single sheet of flexible fabric is folded and creased to form a compact pouch or pocket that can be attached to and detached from a golf bag. The pocket connects to the bag by hooks carded at the opposite ends of the pocket. The pocket has a long central zippered opening in the front, and a pleated back, but is constructed so that, when empty, the pocket lies flat against the golf bag.

7 Claims, 2 Drawing Sheets

Fig. 1.
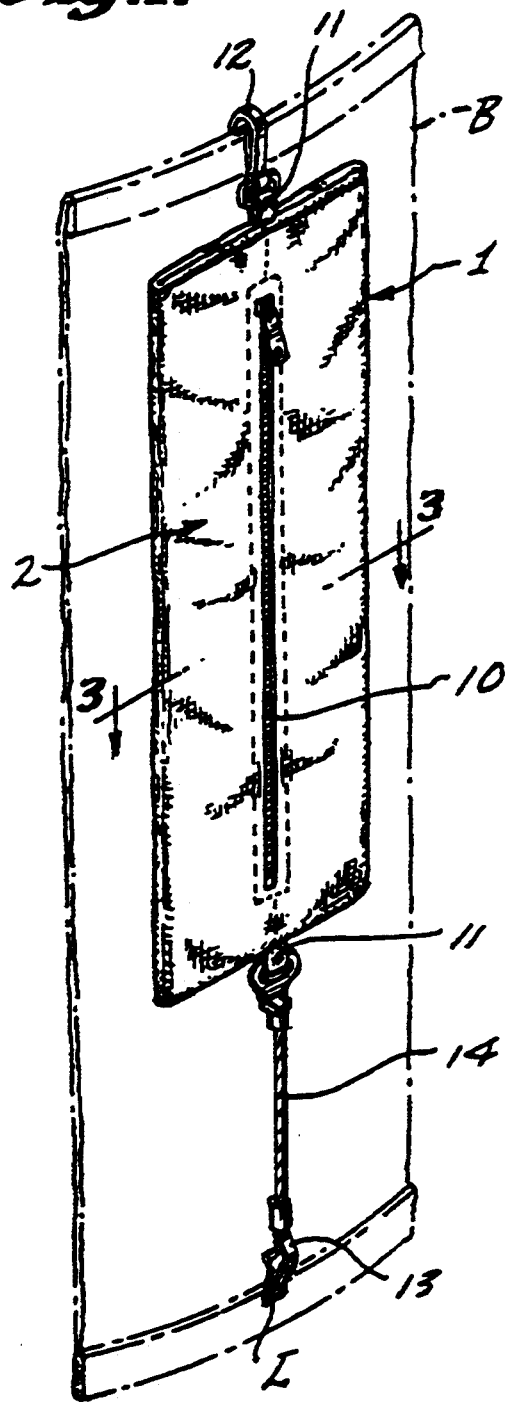
Fig. 2.
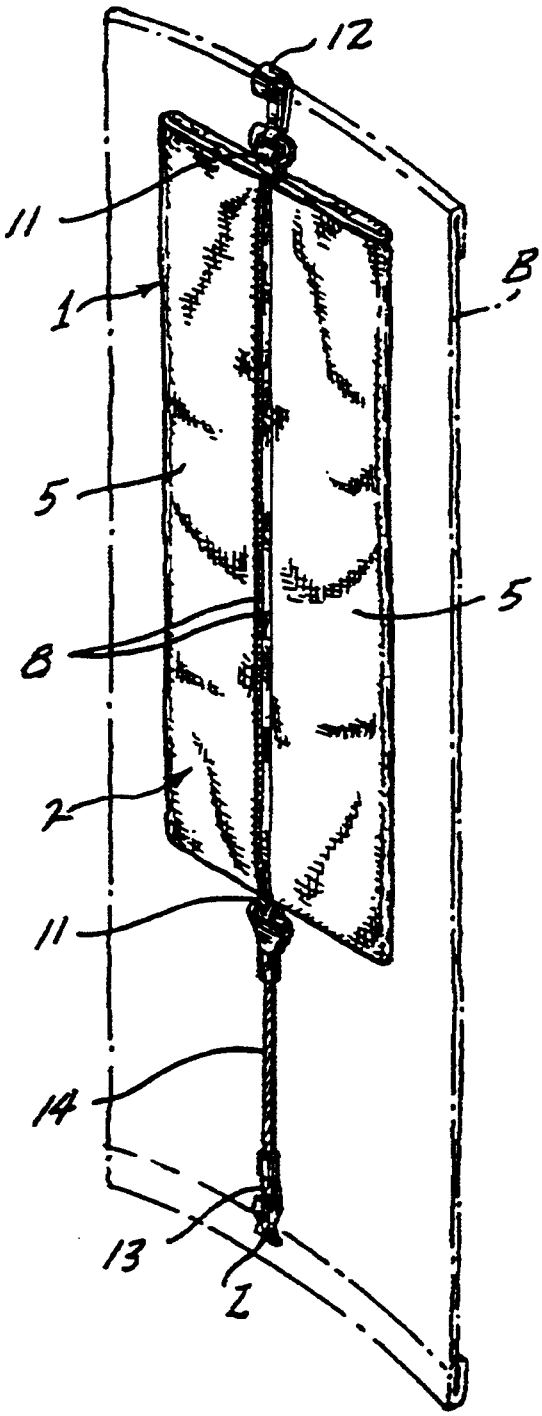
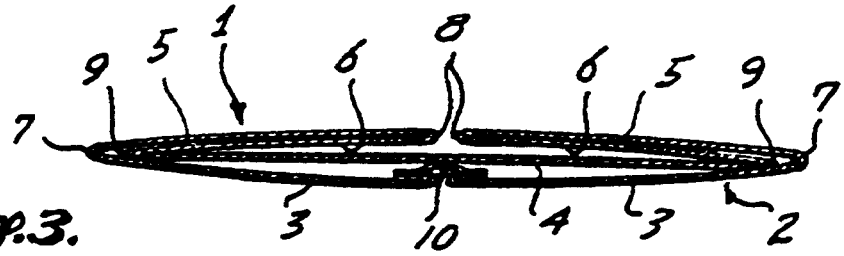
Fig. 3.

Fig. 4.
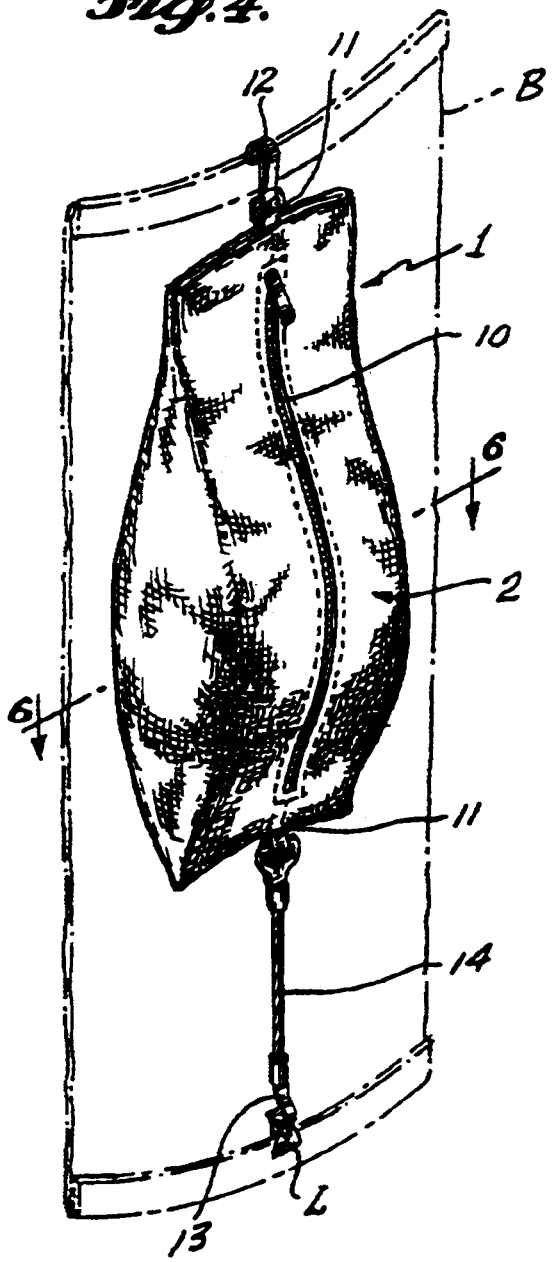
Fig. 5.
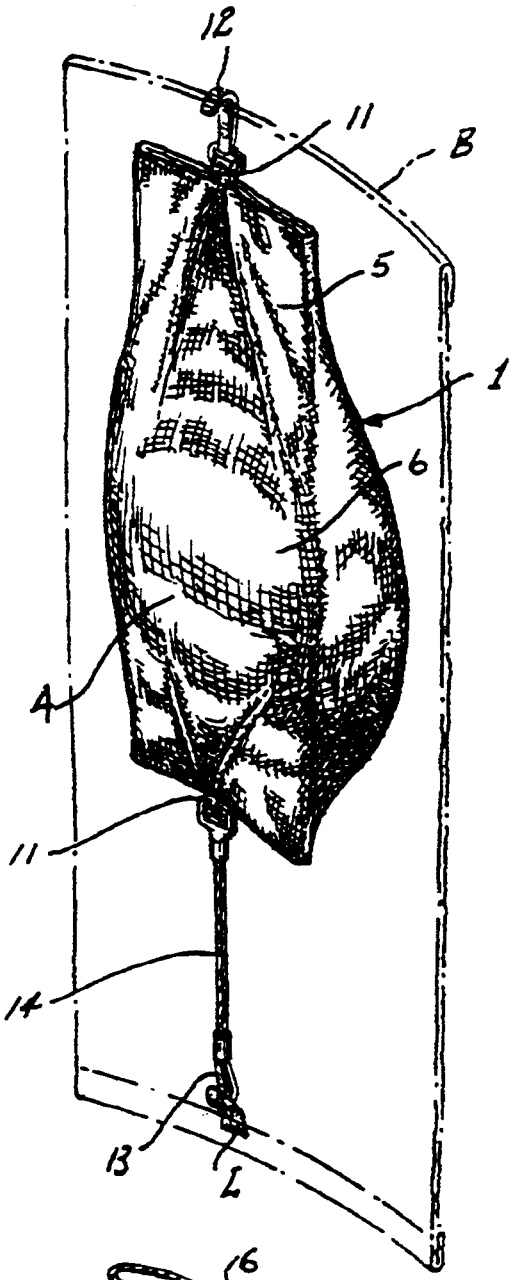
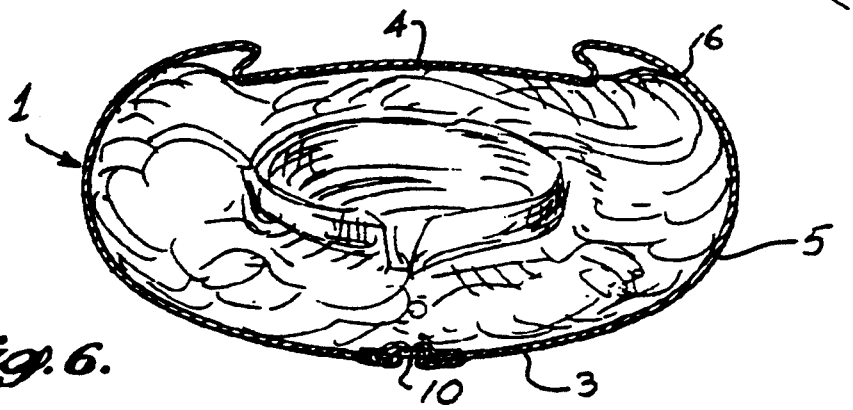
Fig. 6.

ADD-ON POCKET FOR GOLF BAGS

FIELD OF THE INVENTION

The present invention relates to a special pouch or pocket attachable to a golf bag for storage of golf accessories, clothing or other articles.

BACKGROUND OF THE INVENTION

The following patents illustrate prior devices for providing supplemental storage for a golf bag or a golf cart:

U.S. Pat. No. 715,759 (Crane)
U.S. Pat. No. 1,718,952 (Fischer)
U.S. Pat. No. 1,739,780 (Buhrke)
U.S. Pat. No. 3,373,911 (Kebelbeck)
U.S. Pat. No. 4,032,054 (Duncan)
U.S. Pat. No. 4,350,194 (Brown)
U.S. Pat. No. 4,459,827 (Rhodes)
U.S. Pat. No. 4,869,365 (Perdue et al.)
Canadian Patent No. 613,456 (Amess)

The patents issued to Crane and Fischer disclose special holders for golf balls.

The patent issued to Buhrke discloses a special holder for golf tees.

The Kebelbeck patent discloses a "shoe pack" attachable to a golf cart.

The patent issued to Duncan discloses a holder or caddy for miscellaneous golfing paraphernalia.

The patent issued to Brown discloses a golf bag having detachable pockets that can be secured to the golf bag in desired positions by snaps or hook-and-pile fasteners.

The patent issued to Rhodes discloses a holder for beverage cans.

The patent issued to Perdue et al. discloses a plurality of pockets carried on a backing panel which, in turn, is attachable to a golf bag.

The Canadian patent discloses an umbrella holder.

Of the above patents, only Perdue et al. and Brown disclose general purpose compartments attachable to a golf bag, but the compartments protrude from the bag and the attaching mechanism is of complicated construction.

SUMMARY OF THE INVENTION

The present invention provides a compact pouch or pocket that can be quickly and easily attached to and detached from carriers, particularly carriers for sports equipment, and, more particularly, golf bags of different designs. In the preferred embodiment, the body of the pocket is formed by a single sheet of flexible fabric sufficiently stiff that it tends to retain its shape. The pocket is rectangular and has a long central zippered opening in the front for access to the interior. The back of the pocket has a folded pleat so that the internal volume can be greatly increased for holding a bulky article such as a jacket or sweater. However, when empty, the pocket lies flat against the golf bag, or, if detached from the bag, the pocket lies flat in a compact condition, but it can be folded or rolled to an even more compact condition. Preferably the pocket connects to the golf bag by hooks, one of which is carried by a length of resilient cord for tensioning the pocket when connected to the golf bag.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 1 is a somewhat diagrammatic top front perspective of an add-on pocket for golf bags in accordance with the present invention, with a fragment of a golf bag being shown in broken lines to illustrate attachment of the pocket to the bag;

FIG. 2 is a top rear perspective of the pocket of FIG. 1;

FIG. 3 is a transverse section along line 3—3 of FIG. 1, but on a larger scale;

FIG. 4 is a top front perspective of the pocket of FIG. 1, but illustrating the condition of the pocket when partially filled with a bulky article;

FIG. 5 is a top rear perspective of the pocket of FIG. 4; and

FIG. 6 is a transverse section along line 6—6 of FIG. 4 on a scale larger than the scale of FIGS. 1, 2, 4 and 5 but smaller than the scale of FIG. 2.

DETAILED DESCRIPTION OF THE PREFERRED EMBODIMENT

With reference to FIGS. 1, 2 and 3, the add-on pocket 1 in accordance with the present invention has an elongated body 2 which preferably is formed of a single sheet of flexible material, preferably fabric, such as a weather resistant nylon. As best seen in FIG. 3, the body of the pocket includes a rectangular front panel 3 and a rectangular back panel 4. In the empty condition of the pocket shown in FIGS. 1, 2 and 3, the back panel is disposed substantially flat against the front panel. The front and back panels are joined at their side edges by integral pleat panels folded rearward and inward from the front and back panels. The pleat panels include rear half panels 5 folded inward from the side edges of the front panel 3 and forward half panels 6 folded inward from the side edges of the back panel 4.

Each rear half panel 5 meets a longitudinal edge of the front panel 3 at a crease 7. From such crease the half panel 5 (in the empty condition of the pocket illustrated in FIGS. 1, 2 and 3) extends inward to approximately the center line of the pocket where the rear half panel 5 meets the forward half panel 6 at a crease 8. From crease 8 the forward half panel extends outward to a crease 9 where the forward half panel is joined to the back panel 4 at one of its longitudinal edges.

With the pocket empty, the forward and rear half panels at each side of the pocket are folded flat against the back panel leaving a narrow space between the creases 8 at approximately the center of the back panel 4. The opposite end portions of the pocket are sewn to join the end margins of the front panel 3, back panel 4 and half panels 5 and 6 together. Preferably the fabric used for the main body of the pocket is of a material stiff enough that the creases are permanent, and the body tends to return to the flat, folded condition illustrated in FIGS. 1, 2 and 3.

The front panel 3 has a long slit extending substantially the full length of the front panel 4 for a zipper 10. The ends of the pocket can be sewn with the pocket in an inside-out orientation, such that when the panels are drawn back through the zipper opening, the end seams are not exposed.

Fabric end loops 11 are provided at both ends of the pocket for connection of fasteners in the form of rigid hooks 12 and 13. One hook, the top hook 12 as illustrated in FIGS. 1 and 2, is joined directly to an end loop 11, whereas the other hook 13 is joined to the other end loop 11 by a short length of resilient cord 14.

The pocket in accordance with the present invention can be conveniently attached to a golf bag B by fitting the top hook 12 over the top lip of the bag and the bottom hook 13 on a ring or loop L provided on the bag. In a representative embodiment the length of the pocket can be about 18 inches and the cord 14 in relaxed condition can be about 8 inches long. On many golf bags there will be a ring or loop L approximately 28 inches to 30 inches from the top of the bag for use in carrying a golf umbrella, strap or other accessory. Such ring or loop L can be used for connection of the bottom hook 13. If necessary, a separate ring or loop can be secured to the bag.

In the empty condition illustrated in FIGS. 1, 2 and 3, the pocket rests substantially flat against the exterior of the golf bag B with the rear half panels 6 facing the bag. Access to the interior of the pocket can be accomplished conveniently by unzipping the front panel 3. There are no exposed pleats at the sides of the pocket, only the creases 7. However, the pleated construction of the rear of the pocket allows for the volume of the central portion of the pocket to be greatly expanded. A bulky article, such as a sweater or jacket, can be carried in the interior. The expanded condition of the pocket is illustrated in FIGS. 4, 5 and 6, where the back panel 4 is forced away from the front panel 3 and the half panels 5 and 6 are unfolded. However, when the article is removed, the add-on pocket in accordance with the present invention returns to the flat condition illustrated in FIGS. 1, 2 and 3; and, when removed from the golf bag, the add-on pocket can be conveniently rolled or folded to an even more compact condition.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An add-on pocket for a golf bag comprising a body of flexible sheet material having a front, a back, opposite ends, and opposite sides, said sides being devoid of pleats and being formed by creases between said front and back, said front having an opening for access to the interior of said body, said front and back having opposite end margins adjacent to said opposite ends of said body which margins are secured together for normally maintaining said body in a flat creased condition, said back having at least one pleat for expansion of the central portion of said body from a flat, empty condition to an expanded, article-containing condition, and a pair of fasteners carried by said body adjacent to said opposite ends, respectively, and connected to each other only through the flexible sheet material of said body with no rigid interconnection or reinforcement.

2. The pocket defined in claim 1, in which the front is formed by a rectangular front panel having opposite longitudinal edges formed by the opposite sides of the body, the back being formed by a back panel having opposite longitudinal edges extending generally parallel to the opposite sides of the body and half panels joining and folded rearward and inward from said opposite longitudinal edges of said front panel and from said opposite longitudinal edges of said back panel, respectively;

3. The pocket defined in claim 1, in which the fasteners are hooks.

4. An add-on pocket for a golf bag comprising a sheet of flexible material having a front panel with opposite longitudinal creased edges, a back panel with opposite longitudinal creased edges and normally disposed substantially face-to-face with said front panel and, at each longitudinal side of said front panel and said back panel a pair of pleat panels, each of said pleat panels including a rear half panel joined to said front panel and extending from one of said longitudinal creased edges of said front panel and a forward half panel joined to said back panel and extending from one of said longitudinal edges of said back panel, said rear and forward half panels of each of said pair of pleat panels having inner edges remote from said longitudinal creased edges of said front and back panels, said inner edges being positioned behind said back panel and being joined together, remote from said front panel, and closely adjacent to said inner edges of the forward and rear half panels of the other of said pair of pleat panels, said front, back and pleat panels having opposite end margins secured together to form a closed body and for normally maintaining said body in flat creased condition, said front panel having an opening for access to the interior of said body, and a pair of fasteners carried by said body adjacent to said opposite end margins, respectively, and connected to each other only through the flexible sheet material of said body with no rigid interconnection or reinforcement.

5. The pocket defined in claim 4, in which the fasteners are hooks.

6. An add-on pocket comprising a sheet of flexible material having a front panel with opposite longitudinal creased edges, a back panel with opposite longitudinal creased edges and normally disposed substantially face-to-face with said front panel and, at each longitudinal side of said front panel and said back panel a pair of pleat panels, each pleat panel of said pair of pleat panels including a rear half panel joined to said front panel and extending from one of said longitudinal edges of said front panel and a forward half panel joined to said back panel and extending from one of said longitudinal edges of said back panel, said rear and forward half panels of each pleat panel of said pair of pleat panels having inner edges remote from said longitudinal creased edges of said front and back panels, said inner edges being positioned behind said back panel and being joined together, remote from said front panel, and closely adjacent to said inner edges of the rear and forward half panels of the other pleat panel of said pair of pleat panels, said front, back and pleat panels having opposite end margins secured together to form a closed body and for normally maintaining said body in flat creased condition, said front panel having an opening for access to the interior of said body, and a pair of fasteners carried by said body adjacent to said opposite end margins, respectively, and connected to each other only through the flexible sheet material of said body with no rigid interconnection or reinforcement.

7. An add-on pocket comprising a body of flexible sheet material having a front, a back, opposite ends, and opposite sides, said sides being devoid of pleats and being formed by creases between said front and back, said front having an opening for access to the interior of said body, said front and back having opposite end margins adjacent to said opposite ends of said body which margins are secured together for normally maintaining said body in a flat, creased condition, said back having at least one pleat for expansion of the central portion of said body from a flat, empty condition to an expanded, article-containing condition, and a pair of fasteners carried by said body adjacent to said opposite ends, respectively, and connected to each other only through the flexible sheet material of said body with no rigid interconnection or reinforcement.

* * * * *